US007682487B2

(12) United States Patent
Sundberg et al.

(10) Patent No.: US 7,682,487 B2
(45) Date of Patent: Mar. 23, 2010

(54) PRODUCT FOR USE IN PAPERMAKING AND PREPARATION THEREOF

(75) Inventors: Kenneth Sundberg, Åbo (FI); Jouko Käki, Turku (FI); Tiina Luttikhedde, Raisio (FI); Guomei Peng, Shirley (GB)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 487 days.

(21) Appl. No.: 11/630,088

(22) PCT Filed: Jun. 28, 2005

(86) PCT No.: PCT/EP2005/006946

§ 371 (c)(1),
(2), (4) Date: Dec. 19, 2006

(87) PCT Pub. No.: WO2006/002867

PCT Pub. Date: Jan. 12, 2006

(65) Prior Publication Data

US 2008/0017340 A1 Jan. 24, 2008

(30) Foreign Application Priority Data

Jun. 29, 2004 (FI) ..... 20040898

(51) Int. Cl.
*D21H 11/00* (2006.01)

(52) U.S. Cl. ..... 162/179; 162/158; 106/177; 106/287.24; 106/213

(58) Field of Classification Search ..... 162/179, 162/158; 106/177, 287.24, 213
See application file for complete search history.

(56) References Cited

U.S. PATENT DOCUMENTS 4,673,439 A 6/1987 Takahashi et al. ..... 106/287.24

FOREIGN PATENT DOCUMENTS

| | | | |
|---|---|---|---|
| FR | 2396 120 | * | 6/1978 |
| FR | 2 396 120 | | 1/1979 |
| GB | 1 569 591 | | 6/1980 |

* cited by examiner

*Primary Examiner*—Mark Halpern
(74) *Attorney, Agent, or Firm*—Shiela A. Loggins

(57) ABSTRACT

A paper sizing composition, comprising at least one first sizing component dispersed in water, the said sizing component being prepared of a reaction product of a maleic anhydride and a fatty acid component, and an aluminium component. The fatty acid component comprises an alkyl ester of one or more fatty acids selected from a vegetable oil based fatty acid mixture. The particle size of the particles in said first sizing component has been reduced so that in the dispersion at least 50% of the particles are <2.5 μm, at least 75% of the particles are <4 μm and at least 90% of the particles are <5 μm, preferably so that at least 50% of the particles are <2 μm, at least 75% of the particles are <3 μm and at least 90% of the particles are <4 μm.

22 Claims, No Drawings

PRODUCT FOR USE IN PAPERMAKING AND PREPARATION THEREOF

This application is a 371 of PCT/EP05/06946 filed 28 Jun. 2005.

The present invention relates to a paper sizing dispersion as stated in the preamble of appended independent patent claims, to a method for preparation of a sizing dispersion and to the use of a sizing dispersion.

The present invention thereby more particularly refers to a paper sizing dispersion, comprising dispersed in water at least one first sizing agent based on a reaction product between maleic anhydride and a fatty acid component. Other substances, such as fibres, chemicals, additives, fillers and/or other auxiliary materials used in papermaking may thereby be mixed, dissolved or dispersed in the water into which the sizing agent is dispersed. As used in this description, the term to disperse includes, unless otherwise stated, to suspend small solid particles and/or to emulsify droplets in liquid to prepare a dispersion.

Sizing of paper enables, inter alia, control of ink or colour absorption by the surface of printing, copying or writing papers. Sizing, e.g. sizing of liquid packaging board, may also be used to prevent liquid absorption into the paper. Paper sizing may also be used to strengthen bonds between fibres and thus increase the wet strength of papers, such as packaging board, liner, fluting or filter paper.

It is known to use rosin size for paper sizing at acid pH conditions. Rosin size is precipitated by alum onto the fibres in the papermaking pulp, the size thereby providing them with a hydrophobic cover. Normally rosin size is not used in neutral conditions. Thus normally it is not suitable to use rosin size when the papermaking pulp includes calcium oxide based fillers, such as PCC (precipitated calcium carbonate) fillers.

It is known, in neutral conditions, to use alkyl keten dimer and alkenyl succinic anhydride based sizes, that is AKD (alkyl keten dimer) and ASA (alkenyl succinic anhydride) sizes, which are dispersed in a dispergator to form size dispersions. In AKD- and ASA-size dispersions the size particles are able to precipitate directly, without alum, onto fibres. The size is dispersed into the fibre suspension with cationic starch. The size droplets are thereby being precipitated with a retention agent onto the fibres onto which the size is spreading only after water is evaporating therefrom. Starch, used for dispersing the size, may also be used as the retention agent.

It has been suggested in U.S. Pat. No. 3,102,064 to use reaction products between cyclic dicarboxylic anhydride and alkenyl groups for sizing.

It has been suggested in Finnish patent application no. 782058 that long chained succinic anhydride derivatives, such as reaction products of maleic anhydride and oleic acid esters, which have more than 24 carbon atoms, are used for sizing. By connecting a long carbon chain to an acid or ester function, the molecular weight of a size molecule may be increased to a desired level.

Most reaction products of long-chained, $C_5$-$C_8$, alkyl-oleates and maleic anhydrides provide, according to FI 782058, acceptable results. Whereas reaction products between short-chained methyl or ethyl esters of monounsaturated $C_{18}$ fatty acid, i.e. oleic acid, and maleic anhydrides do not provide a desired sizing performance. Further there is mentioned another problem arising from the use of short-chained esters, such as methyl or ethyl esters, of oleic acid in the preparation of sizing agents, the problem being the formation of black polymer material in the reaction product of maleic anhydride and oleate.

It is an object of the present invention to provide an improved sizing dispersion and an improved method of preparation of a sizing dispersion, in which aforementioned problems have been minimized.

It is thereby an object of the present invention to provide a vegetable oil based sizing agent, able to provide a sizing effect comparable to the sizing effect of ASA-sizes. It is thereby also an object of the present invention to provide a sizing dispersion, in the preparation of which cheap raw materials may be used.

The sizing dispersion and the method of preparation of a sizing dispersion, according to the present invention, are in order to achieve above mentioned objects characterized by what is stated in the characterizing portions of appending independent claims.

Thereby, a typical sizing agent of a sizing dispersion according to the present invention is composed of a reaction product between maleic anhydride and a methyl ester of one or more fatty acids selected from a vegetable oil based fatty acid mixture, which reaction product in this description is denoted FAME-size. Maleic anhydride is connected, in a manner known per se, to the double bond of the methyl ester, typically at a high (210-220° C.) temperature. The sizing agent may be produced in a similar manner of an other alkyl ester, such as of an ethyl ester or propyl ester.

A typical sizing dispersion containing FAME-size, according to the present invention, further comprises an aluminium compound, such as aluminium sulphate i.e. alum, polyaluminium sulphate or polyaluminium chloride (PAC), having an impact on the sizing effect. This addition has surprisingly been noticed to have a significant effect on achieving a good sizing performance.

A sizing dispersion, according to the present invention, relates, unless otherwise stated, to additives being added to a papermaking fibre suspension and having an impact on the paper sizing performance, said additives including at least

- a first sizing agent, a FAME-size, and
- a second agent having an influence on the sizing performance, an aluminium compound.

These agents may, according to the present invention, be introduced into the fibre suspension simultaneously, as a ready made dispersion, or separately, so as for the agents to form a dispersion in the fibre suspension. The agents may therefore be added into the fibre suspension

- at different points of the process, one before the other, or
- both at the same point of the process, separately or together, mixed or as a proper dispersion.

The sizing agent according to the present invention, the FAME-size and the aluminium compound, typically alum, are preferably added into the fibre suspension while stirring vigorously, in order for a sizing dispersion to be formed and/or maintained in the fibre suspension.

It has now been noticed that the aluminium compound, typically alum, has a significant, even critical, impact on achieving a good sizing performance with said FAME-sizes. It has further been noticed, that also the point in the papermaking process at which the aluminium compound is added into the fibre suspension is of great importance.

It has been noticed that it is preferable to add the sizing dispersion into the fibre suspension at a relatively early stage, e.g. into the machine chest of the paper machine, so as to achieve a longer reaction time than could be achieved by adding the sizing dispersion in connection with the head box. Also the concentration of the fibre suspension at the feeding point of the sizing dispersion may be of importance. It is believed that a better sizing is achieved, if the sizing dispersion is fed into a fibre suspension having a low concentration, than if the sizing dispersion is fed into a fibre suspension having a higher concentration, e.g. by spraying onto the web at the wire part.

In order to prepare a sizing dispersion FAME-size is dispersed by vigorously mixing into water. Typically, a surfactant has been added into the water in order to decrease the particle size of the sizing agent drops and/or sizing agent particles being formed in the dispersion. The particle size of the sizing agent droplets and/or particles are controlled by the strong mixing and/or by the addition of surfactant. Typically a sizing dispersion is prepared having particles of which least 50% are <2.5 μm, at least 75% are <4 μm and at least 90% are <5 μm, preferably having particles of which at least 50% are <2 μm, at least 75% are <3 μm and at least 90% are <4 μm. The said surfactant may be added into the water before the dispersion of sizing agent into the water, simultaneously with the introduction of the sizing agent or after the introduction of the sizing agent.

Vegetable oil based fatty acid mixtures suitable for the preparation of sizing agents may be achieved e.g. from plant seed oils, such as rape seed oil, soybean oil, linseed oil or sunflower oil. Typically, for the preparation of a sizing dispersion according to the present invention, such oils are chosen which provide fatty acid mixtures having considerable amounts of monounsaturated fatty acids.

In the fatty acids used for the preparation of a sizing dispersion the share of monounsaturated fatty acids should be >50%, preferably >80%, most preferably >90%. The fatty acid mixture should preferably have only very small amounts, <40%, of polyunsaturated fatty acids, if any. Also the share of saturated fatty acids should be small typically <20%, preferably <15%, most preferably <10%.

Next results from a study, in which fatty acid compositions of some common seeds were analysed, are given in Table I.

TABLE I

| Seed | polyunsaturated (linolenic and linoleic acid) % | mono-unsaturated (oleic acid) % | saturated % |
|---|---|---|---|
| rape seed | 37 | 54 | 7 |
| hydrogenated rape seed | 0-2 | 88 | 10 |
| soy bean | 57 | 26 | 6 |
| conventional sunflower | 65 | 23 | 12 |
| modified sunflower | 0-1 | 91 | 8 |
| linseed | 72 | 19 | 4 |
| corn | 59 | 24 | 17 |

It can be taken from Table I, that oil from rape seed, which according to this study contains more than 50% monounsaturated $C_{18}$ oleic acid, is, as such, particularly well suited to be used in the preparation of a sizing dispersion according to the present invention. Polyunsaturated fatty acids in rape seed oil may by selective hydrogenation be converted to monounsaturated fatty acids to provide a rape seed oil that has >90% monounsaturated oleic acid.

It can further be taken from Table I, that the share of monounsaturated fatty acids in a fatty acid mixture of soy bean oil and conventional sunflower oil is only about 25%. The share of polyunsaturated fatty acids in these oils is correspondingly about 60%. Also in this case the polyunsaturated fatty acids may be hydrogenated by selective hydrogenation to monounsaturated fatty acids, after which these fatty acids, as well, very well may be used in the preparation of a sizing dispersion according to the present invention. By selective hydrogenation it is possible to increase the share of monounsaturated fatty acids in a fatty acid mixture e.g. to >60%, even to >90%, and to decrease the share of polyunsaturated fatty acids correspondingly. There are on the other hand modified plants, such as sunflower plants, having a higher share of monounsaturated fatty acids than corresponding conventional sunflower plants.

The methyl ester needed for the preparation of a sizing agent according to the present invention may be made of a selected vegetable based oil, or a vegetable based oil fatty acid, by a transesterification or esterification known per se.

It is on the other hand possible to buy suitable vegetable oil methyl esters as ready made inexpensive bulk products from large-scale producers of oleo chemicals. Large-scale producers of oleo-chemicals produce e.g. methyl ester of rape seed oil (rape seed methyl ester, RME) as a bulk product, usable e.g. as a bio-fuel. Rape seed methyl ester thereby is easy to get and is more price worth than ASA-size components particularly produced for size production.

Table II shows the compositions, that is the shares of saturated, monounsaturated and polyunsaturated $C_{16}$-$C_{18}$ fatty acids in rape seed oil based methyl ester products from three producers.

TABLE II

| | Saturated (%) | | | Mono-unsaturated (%) | | | Poly-unsaturated (%) | | |
|---|---|---|---|---|---|---|---|---|---|
| | $C_{16}$ | $C_{18}$ | $C_{20}$ | $C_{16:1}$ | $C_{18:1}$ | $C_{20:1}$ | $C_{18:2}$ | $C_{18:3}$ | $C_{20:2}$ |
| RME1 | 4.7 | 1.7 | 0.6 | 0.2 | 60.7 | 1.3 | 20.4 | 9.0 | 0.1 |
| RME2 | 4.5 | 1.8 | 0.6 | 0.2 | 60.1 | 1.3 | 19.7 | 10.3 | 0.1 |
| RME3 | 3.4 | 1.7 | 0.5 | 0.1 | 59.1 | 1.0 | 21.4 | 11.7 | 0.1 |

In commercially available methyl ester mixtures of rape seed oils the share of methyl esters of monounsaturated Cis fatty acids, that is of oleic acid, is about 60% whereas the share of esters of polyunsaturated fatty acids is only about 30%. These commercially available products thereby are well suited for being used in the preparation of sizing dispersions according to the present invention.

It was noted above in Table I, that many other vegetable oil based fatty acids and thus the methyl esters prepared therefrom include besides the monounsaturated oleic acid or the methyl ester of oleic acid (methyl oleate) rather large amounts, even >30%, of polyunsaturated fatty acids or their methyl esters, such as linolic acid or methyl-linoleate (with 2 double bonds) and linolenic acid or methyl-linolenate (with 3 double bonds). These polyunsaturated acids or methyl esters attempt to react stronger than the oleic acid or the methyl oleate, as well as, many times both with each other, and with maleic anhydride, thus forming polymeric by-products. It has now been noticed that polymer material thus formed may besides impair the sizing performance cause runnability problems in processes, where it is present. A high polymer content may cause a dark colour and increase the viscosity of the size, even considerably.

One can try to decrease the polymer formation by controlling the reaction conditions in the reactions between maleic anyhdride and fatty acid esters. It is thus, for instance, possible to decrease polymer formation to below a 10% polymer level by using radical-inhibitors and nitrogen atmosphere in the reactions.

Polymer formation can, on the other hand, be decreased or prohibited by converting polyunsaturated fatty acids or esters in a fatty acid mixture, as above was shown, by selective hydrogenation to monounsaturated fatty acids or esters, which do not form polymers as easily, or by removing polymer compounds from the product, e.g. by distillation. Thus it may be possible to reach a polymerisation level below 1.5%, even below 1%.

It has now further been noticed that also such a sizing dispersion which is prepared of a reaction product between maleic anhydride and a mono-unsaturated fatty acid methyl ester, may contain a portion of relatively large, >3 μm, particles, solid particles or liquid droplets, of sizing agent. It has not earlier been believed that large particles of sizing agent would have a harmful effect on the sizing performance, as this is not the case when using conventional ASA-size dispersions.

It has now, however, surprisingly been noticed that the dimensions of sizing agent particles may in some cases have an impact on the sizing performance of a FAME-size dispersion. It has thereby been noticed that the sizing performance decreases when the number of large, >3 μm, particles of sizing agent increases. When the number of large, >3 μm, particles of sizing agent is limited, a sizing dispersion having a considerably improved sizing performance is obtained. The number of large particles of sizing agent may be limited, e.g. during the preparation of the sizing dispersion, by adding a surfactant into the dispersion and/or by mixing the dispersion vigorously with high shearing force. Surfactants further tend to improve the dispersion process, as such, whereby a good dispersion may be achieved with lower shearing forces.

A multitude of different suitable surface active agents, known per se, may be used as surfactants, such agents as e.g. lignosulphonates, sulphosuccinates, naphtalene-benzene-sulphonates, fatty alcohols, ethoxylated or propoxylated fatty alcohols or various lanolins, such as ethoxylated or propoxylated lanolins. Only small amounts of surfactants are needed, typically about 0.5-2% of the amount of the sizing agent, by dry weight.

Following Tables III-VIII show results of measurements made in laboratory scale and on a pilot paper machine, in which measurements the sizing performances of FAME-sizes according to the present invention, other FAME-sizes and ASA-sizes were studied.

Sheets, 80 g/m$^2$, were made in the laboratory of a fibre suspension of 60% birch/40% pine fibre. Starch, if necessary alum, pH-controlling medium, FAME-size or ASA-size and a retention agent was added to the fibre suspension (fibre stock). Sheets were made of the fibre suspension in a sheet mould. The sizing performances of the sizes were measured with conventional Cobb$_{60}$ and HST laboratory tests.

First, the impact of added alum to the sizing performance of FAME-size was studied. Alum and FAME-size or FAME-size only was in these tests added to a diluted, 0.8%, fibre suspension while vigorously mixing. The sizing dispersion formed was allowed to react 2 minutes before forming the sheet. A sizing dispersion with ASA-size was made in a similar manner. A second FAME-size, according to the present invention, was added to another similar fibre suspension, but not until it was in the sheet mould/former, whereby the addition of alum took place in a more concentrated fibre suspension and the reaction time remained very short.

TABLE III

| | alum | Cobb$_{60}$ g/m$^2$ | HST s |
|---|---|---|---|
| FAME 0.1% | 1% (2 min) | 21.8 | 17.4 |
| FAME 0.15% | 1% (2 min) | 19.9 | 36.6 |
| FAME 1.5% | 1% (2 min) | 22.2 | |
| FAME 0.1% | — | 161.5 | <2 |

TABLE III-continued

| | alum | Cobb$_{60}$ g/m$^2$ | HST s |
|---|---|---|---|
| FAME 0.15% | — | 205 | 0.5 |
| FAME 0.1% | 1% (<<1 min) | 42.9 | |
| FAME 0.15% | 1% (<<1 min) | 29.5 | |
| ASA 0.15% | 1% (2 min) | 20.2 | |
| ASA 1% | 1% (2 min) | 17.6 | |

The results in Table III show that the addition of alum remarkably improves the sizing performance of FAME-size. The Cobb$_{60}$-value decreases from 161.5-205 level to a 19.9-21.8 level, which corresponds to normal ASA-size 20.2-17.6 values. It can be seen that sheets, sized with FAME-size without alum addition, remained practically unsized.

The sizing performance of a low-cost FAME-size, may by the use of alum, as suggested in the present invention, be increased to the level of considerably more expensive sizes. Also the HST-value of FAME-size is improved, i.e. is increased, thanks to the alum addition, although not as significantly.

It can be taken from Table III, that the addition of alum into a diluted fibre solution at an early stage leads to a better Cobb$_{60}$-value than does the addition of alum later to a more concentrated fibre suspension. Nevertheless, also alum added at a later stage improves the sizing performance significantly.

Next, the effect of the particle size in a FAME-size dispersion was studied. The size of particles was decreased by the addition of surfactant into the sizing dispersion. The particle size varied between 0.83 μm-2.3 μm. The concentration of size varied between 0.1-0.4%. The sizing dispersion contained, besides FAME-size, alum. The Cobb$_{60}$ results are given in Table IV.

TABLE IV

| | FAME 0.1% | FAME 0.2% | FAME 0.4% | ASA 0.2% | |
|---|---|---|---|---|---|
| 0.8 μm | 27 | 22 | 23 | | g/m$^2$ |
| 1.2 μm | 24 | 23 | 23 | | g/m$^2$ |
| 1.4 μm | | | | 19 | g/m$^2$ |
| 1.9 μm | | | | 20 | g/m$^2$ |
| 2.0 μm | 22 | 20 | 20 | | g/m$^2$ |
| 2.1 μm | 22 | 22 | 19 | | g/m$^2$ |
| 2.2 μm | 25 | 22 | 21 | 20 | g/m$^2$ |
| 2.3 μm | 25 | 23 | 21 | | g/m$^2$ |

Thus, by using FAME-size it is possible to get, with very small size concentrations, 0.1%-0.4%, Cobb$_{60}$ values that are <25 g/m$^2$, which can be considered to be good. It is possible to get as good results with a FAME-size, in the preparation of which inexpensive vegetable based fatty acid components have been used, as with conventional ASA-size, about 20 g/m$^2$.

The tests made at a pilot paper machine showed that it is possible to get almost same values, 25 g/m$^2$, with FAME-size, at 0.15% and 0.30% size concentrations, as the value, 22-23 g/m$^2$, with ASA-size.

Table V shows the sizing performance of FAME- and ASA-sizes, in which the average particle size has not been decreased by the addition of a surfactant. The sizing performance is given as a Cobb$_{60}$ value.

TABLE V

| | 0.1% | 0.2% | 0.3% | |
|---|---|---|---|---|
| FAME 6.0 μm | 73 | 71 | 69 | $g/m^2$ |
| ASA 2.7 μm | 45 | 25 | 19 | $g/m^2$ |

A very big difference can be seen between the effects achieved by untreated FAME-size and ASA-size. This difference disappears or decreases at least significantly when a surfactant is added to the sizing dispersion to decrease the particle size of the sizing agent.

Table VI shows a comparison between the sizing performances of a FAME-size according to the invention and a conventional ASA-size, in which the sizing performance is measured as $H_2O_2$ $kg/m^2$ edge absorbancy. Edge absorbancy is an important quality criterion of liquid packaging board.

The mean particle size in the FAME-size dispersion has been decreased with the addition of a surfactant.

TABLE VI

| | FAME 0.1% | FAME 0.2% | FAME 0.4% | ASA 0.1% | |
|---|---|---|---|---|---|
| 2.0 μm | 2.3 | 1.5 | 1.0 | | $kg/m^2$ |
| 2.1 μm | 2.0 | 1.4 | 1.0 | | $kg/m^2$ |
| 2.2 μm | 1.7 | 1.2 | 1.0 | 0.9 | $kg/m^2$ |
| 2.3 μm | 1.9 | 1.1 | 0.9 | | $kg/m^2$ |

These tests show that it is possible to achieve a similar sizing performance with FAME-size as with corresponding conventional ASA-size.

Tests made at a pilot paper machine show correspondingly that it is possible to achieve with a FAME-size, at 0.15% and 0.30% size concentration, almost same values, 0.63-0.44 $kg/m^2$, as the values 0.35-0.41 $kg/m^2$, in corresponding pilot tests with ASA-sizes. In these tests a 1 $kg/m^2$ value in the sizing of liquid packaging board is considered to be a certain upper limit. The FAME-size easily stays below this limit.

The sizing performance of FAME-size is further shown in Table VII as an edge absorbance of lactic acid, given in $kg/m^2$. The mean particle size in the FAME-size dispersion has been decreased with the addition of a surfactant.

TABLE VII

| | FAME 0.1% | FAME 0.2% | FAME 0.4% | ASA 0.1% | |
|---|---|---|---|---|---|
| 2.0 μm | 2.1 | 1.7 | 1.6 | | $kg/m^2$ |
| 2.1 μm | 2.4 | 2.0 | 1.7 | | $kg/m^2$ |
| 2.2 μm | 1.9 | 1.7 | 1.5 | 0.7 | $kg/m^2$ |
| 2.3 μm | 1.8 | 1.7 | 1.6 | | $kg/m^2$ |

These tests also show that FAME-size provides a relatively good sizing performance, not quite as good as ASA-size, though.

Table VIII shows the sizing performance of a FAME-size in which the particle size has not been decreased with a surfactant. The sizing performance is given as HST, s values.

TABLE VIII

| | 0.1% | 0.2% | 0.3% | |
|---|---|---|---|---|
| FAME (6.0 μm) | 1 | 1 | 2 | s |
| ASA (2.7 μm) | 5 | 90 | 240 | s |

It can be taken from Table VIII that the HST values of untreated FAME-size and conventional ASA-size differ significantly from each other, contrary to the sizing performances of treated FAME-size and conventional ASA-size.

A protective colloid may besides alum be added to the sizing dispersion in order to improve the stability of the sizing dispersion and to improve the dispersibility of the sizing dispersion into the fibre suspension. These protective colloids may also be used for improving the retention of sizing agent onto the fibres, particularly in systems having a high anionic charge, i.e. a large amount of anionic interfering additives. Such a high anionic charge is typically present in fibre suspensions containing mechanical pulp.

The protective colloids typically are polymers, having a relatively high molecular weight, typically tens of thousands even millions of Daltons. Starch, such as potato, corn or tapioca starch may be used as a protective colloid, preferably cationic and partly degraded starch. The starches usually are in liquid form, particularly the high cationic (DS>0.1) starches.

Advantageously, also other polysaccharides, such as mannan or CMC (carboxy methyl cellulose), or synthetic polymers, such as polyacrylamide, may be used as protective colloids. The consumption of protective colloids, by dry weight, is typically 0.2-10, most typically 0.2-2, times the amount of the size agent used.

If needed, the sizing performance, the hydrophobity or the sizing characteristics of the FAME-size according to the present invention, may be changed or increased by adding into the sizing dispersion a second sizing agent, such as AKD-size known per se, conventional ASA-size, SMA (styrene maleic anhydride)-size or SA (styrene acrylate)-size or rosin size, in order to achieve the desired sizing performance or other property. For example AKD-size, made of a raw material containing at least partly unsaturated and/or branched fatty acids, may be used as an additive in FAME-size, whereby certain sizing performances may be achieved.

The raw materials of FAME-size and AKD-size may if desired be mixed with each other already before the actual dispersing of the FAME-size to a sizing dispersion. Then the AKD-size preferably is liquid at the mixing temperature. The raw material mixture may be delivered as such to the paper mill, then the mill does not need any equipment for combining of these substances.

It is, on the other hand, possible to change the sizing performance of the FAME-size or to change or increase its properties by adding into the sizing dispersion besides the aforementioned polymeric hydrophobicity providing additives other additives, as well. These other additives may be polymer dispersions, such as SA-dispersions, or liquid polymers, such as SMA-polymers. The FAME-size may easily be combined with polymer dispersions or liquid sizing agents by dispersing. The sizing dispersion made may be stabilized with a protective colloid, e.g. with cationic starch, in a known manner.

A sizing dispersion according to the present invention may be used in the sizing of different types of papers, in internal sizing, as well as, in surface sizing. The sizing dispersion according to the present invention may thereby be used e.g. in the sizing of different printing papers, magazine papers, newsprint papers and copying papers.

Paper denotes in this description, unless otherwise stated, all kinds of papers, boards or other corresponding fibrous products. Paper may be made of mechanical pulp, such as groundwood pulp, refiner mechanical pulp or TMP pulp, chemical pulp or a mixture of these or of other corresponding pulp known per se. The sizing dispersion according to the present invention is also well suited for being used in the sizing of paper based on recycled fibres. The sizing dispersion according to the present invention may also be used for sizing of various paper boards, such as liner, fluting, packaging board or liquid packaging board.

A sizing dispersion according to the present invention is particularly well suited to be used for such papers, particularly magazine papers or newsprint papers, in which the share of mechanical pulp or recycled fibre pulp is significant and which papers should not be over-sized, that is when it is important that the sizing process can be controlled. This may be the situation when a too efficient sizing process could lead to too high hydrophobicity, which could deteriorate the printing image, such as the offset printing image, or copying image, e.g. with an ink-jet printer.

A sizing dispersion according to the present invention, which contains FAME-size and alum, can be used for sizing of such copying papers, which are used in circumstances in which the size may melt, as the present size does not migrate as other sizes do. For instance, AKD-sizes may when melting migrate and thereafter again solidify on cold surfaces of the apparatus, causing runnability and quality problems.

In fine paper production a filler is usually added to the fibre suspension, which may lead to an increased need of sizing in the paper making process, particularly if large amounts of filler are used. The size has then to prevent also the filler from being wetted. A sizing dispersion according to the present invention is well suited for sizing of these filler containing pulps.

It is not the intention to limit the present invention to the above mentioned exemplary applications of the present invention, it is the intention to use the invention within the scope of the appending patent claims.

The invention claimed is:

1. A paper sizing dispersion, which comprises dispersed in water at least one first sizing agent, and the first sizing agent comprises a reaction product of maleic anhydride and a fatty acid component, wherein said fatty acid component comprises an alkyl ester of one or more fatty acids selected from a vegetable oil based fatty acid mixture, and the sizing dispersion additionally comprises an aluminium compound which is aluminum sulfate alum, polyaluminum sulfate or polyaluminum chloride characterized by at least 50% of the particles of said first sizing agent in the sizing dispersion, are <2.5 μm, at least 75% of said particles are <4 μm and at least 90% of said particles are <5 μm and the sizing dispersion further comprises a surfactant that reduces the particle size of the first sizing agent.

2. The paper sizing dispersion according to claim 1, wherein the surfactant is selected from the group consisting of:

lignosulphonates, sulphosuccinates, naphthalene benzene sulphonates, fatty alcohols, and lanolins.

3. The paper sizing dispersion according to claim 1, wherein the quantity of surfactant in the sizing dispersion is 0.5-2% by dry weight of the sizing agent.

4. The paper sizing dispersion according to claim 1, wherein said vegetable oil based fatty acid mixture originates from rape seed oil, soybean oil, sunflower oil and/or linseed oil.

5. The paper sizing dispersion according to claim 1, wherein at least >50% of said one or more fatty acids are monounsaturated $C_{18}$ fatty acid, that is oleic acid, and/or fatty acid derived from a polyunsaturated $C_{18}$ fatty acid, made mono-unsaturated by selective hydrogenation.

6. The paper sizing dispersion according to claim 1, wherein <20% of said one or more fatty acids are saturated.

7. The paper sizing dispersion according to claim 1, wherein the sizing dispersion further comprises protective colloids.

8. The paper sizing dispersion according to claim 1, wherein the sizing dispersion comprises in addition to the first sizing agent, a second sizing agent.

9. A method of sizing paper wherein the paper is selected from the group consisting of printing papers, magazine papers, newsprint papers, copy papers, paperboard, packaging board and liquid packaging board by adding the paper sizing dispersion according to claim 1 to the paper.

10. The method according to claim 9, wherein the paper is produced from mechanical pulp and/or of pulp of recycled fibres and/or of pulp having a high content of filler.

11. The method according to claim 1, wherein the paper sizing dispersion is an internal sizing and/or surface sizing dispersion.

12. A method for preparation of a paper sizing dispersion, at which a reaction product constituting a first sizing agent is formed by reacting maleic anhydride with a fatty acid component, including an alkyl ester of one or more fatty acids selected from a vegetable oil based fatty acid mixture, and the reaction product thus formed is dispersed by mixing with water, and the sizing dispersion being prepared by additionally dispersing therein an aluminium compound, which is aluminium sulphate, alum, polyaluminum sulphate or polyaluminum chloride (a) mixing the reaction product obtained with water, into which a surfactant, that reduces the particle size of the sizing agent, has been added or is added, and (b) mixing the sizing dispersion vigorously so as to reduce the particle size of the sizing agent in the sizing dispersion, so that at least 50% of the particles of said dispersion are <2.5 μm, at least 75% are <4 μm and at least 90% are <5 μm.

13. The method according to claim 12, wherein the surfactant is selected from the group consisting of:

lignosulphonates, sulphosuccinates, naphthalene benzene sulphonates, fatty alcohols and lanolins.

14. The method according to claim 12, wherein said one or more fatty acids originate from rape seed oil, soybean oil, linseed oil and/or sunflower oil.

15. The method according to claim 12, wherein at least >50% of said one or more fatty acid are a monounsaturated $C_{18}$ fatty acid, that is oleic acid, and/or a fatty acid derived from a polyunsaturated $C_{18}$ fatty acid, and made mono-unsaturated by selective hydrogenation.

16. The method according to claim 12, wherein <20% of said one or more fatty acids is saturated.

17. The method according to claim 12, wherein a surfactant is added at 0.5-2% by dry weight of the sizing agent, into the sizing dispersion.

18. The method according to claim 12, wherein the reaction product is formed in the presence of an inhibitor preventing or slowing down polymerisation.

19. The method according to claim 12, wherein the reaction product is distilled to remove polymeric reaction products therefrom.

20. The method according to claim 12, wherein a protective colloid is added into the sizing dispersion.

21. The method according to claim 12, wherein in addition to the first sizing agent, a second sizing agent is added into the sizing dispersion.

22. A paper sizing dispersion, which comprises dispersed in water at least one first sizing agent, and the first sizing agent comprises a reaction product of maleic anhydride and a fatty acid component, wherein said fatty acid component comprises an alkyl ester of one or more fatty acids selected from a vegetable oil based fatty acid mixture, and the sizing dispersion additionally comprises an aluminium compound which is aluminum sulfate, alum, polyaluminum sulfate or polyaluminum chloride characterized by at least 50% of the particles of said first sizing agent in the sizing dispersion, are <2.5 μm, at least 75% of said particles are <4 μm and at least 90% of said particles are <5 μm and the sizing dispersion further comprises in addition to the first sizing agent, a second sizing agent.

* * * * *